US009116498B2

(12) United States Patent
Sato

(10) Patent No.: US 9,116,498 B2
(45) Date of Patent: Aug. 25, 2015

(54) IMAGE FORMING DEVICE HAVING BELT CLEANER AND DRUM CLEANER BOTH PROVIDED IN ONE OF DRUM UNITS

(71) Applicant: Shougo Sato, Seto (JP)

(72) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/069,667

(22) Filed: Nov. 1, 2013

(65) Prior Publication Data

US 2014/0056628 A1 Feb. 27, 2014

Related U.S. Application Data

(63) Continuation of application No. 13/051,012, filed on Mar. 18, 2011, now Pat. No. 8,577,259.

(30) Foreign Application Priority Data

Jul. 30, 2010 (JP) ..... 2010-171999

(51) Int. Cl.

| | |
|---|---|
| ***G03G 15/01*** | (2006.01) |
| ***G03G 21/00*** | (2006.01) |
| ***G03G 21/10*** | (2006.01) |
| ***G03G 21/12*** | (2006.01) |

(52) U.S. Cl.

CPC ..... *G03G 21/0041* (2013.01); *G03G 21/105* (2013.01); *G03G 21/12* (2013.01)

USPC ..... 399/120

(58) Field of Classification Search

USPC ..... 399/120, 358, 360, 359, 101

See application file for complete search history.

(56) References Cited

U.S. PATENT DOCUMENTS 6,708,011 B2 * 3/2004 Nomura et al. ..... 399/110
8,000,628 B2 8/2011 Sato et al.

(Continued)

FOREIGN PATENT DOCUMENTS

JP 10-063158 3/1998
JP 2001-005243 A 1/2001

(Continued)

OTHER PUBLICATIONS

Sep. 15, 2014—(US) Non-Final Office Action—U.S. Appl. No. 14/470,036.

(Continued)

*Primary Examiner* — Quana M Grainger

(74) *Attorney, Agent, or Firm* — Banner & Witcoff, Ltd.

(57) ABSTRACT

An image forming device includes a main casing, a plurality of photosensitive accommodated in the main casing, a plurality of developer cartridges detachably mountable in the main casing, an endless belt, a plurality of first cleaning units and first conveying units provided for the respective photosensitive drums, a second cleaning unit for cleaning the endless belt, a second conveying unit, and a third conveying unit. The photosensitive drums include a first photosensitive drum and the developer cartridges include a first developer cartridge corresponding to the first photosensitive drum. The third conveying unit conveys waste developer cleaned by the first cleaning unit and conveyed by the first conveying unit corresponding to the first photosensitive drum and waste developer cleaned by the second cleaning unit and conveyed by the second conveying unit toward a first waste developer accommodating chamber of the first developer cartridge.

18 Claims, 14 Drawing Sheets

(56) References Cited

U.S. PATENT DOCUMENTS

| | | | | |
|---|---|---|---|---|
| 8,175,490 | B2 | 5/2012 | Sato et al. | |
| 8,270,869 | B2 | 9/2012 | Sakuma | |
| 8,457,518 | B1 | 6/2013 | Sakuma | |
| 2007/0140763 | A1 | 6/2007 | Shimizu et al. | |
| 2007/0147872 | A1 | 6/2007 | Nakano | |
| 2008/0166162 | A1 | 7/2008 | Hayashi et al. | |
| 2009/0226205 | A1 | 9/2009 | Sato et al. | |
| 2009/0324284 | A1* | 12/2009 | Ohta | 399/120 |
| 2010/0028041 | A1 | 2/2010 | Sakuma | |
| 2010/0080578 | A1* | 4/2010 | Ichikawa | 399/34 |
| 2011/0255902 | A1 | 10/2011 | Sato et al. | |
| 2013/0121728 | A1 | 5/2013 | Sakuma | |

FOREIGN PATENT DOCUMENTS

| | | | |
|---|---|---|---|
| JP | 2002-304100 | A | 10/2002 |
| JP | 2002-311670 | A | 10/2002 |
| JP | 2003-107828 | A | 4/2003 |
| JP | 2005-266530 | A | 9/2005 |
| JP | 2007-171773 | A | 7/2007 |
| JP | 2009-210937 | A | 9/2009 |
| JP | 2010-038947 | A | 2/2010 |

OTHER PUBLICATIONS

Japanese Office Action for application No. 2010-171999 dated Jul. 29, 2014.

English Translation of JP 2005-266530 A.

Jan. 15, 2015—(US) Final Office Action—U.S. Appl. No. 14/470,036.

* cited by examiner

IMAGE FORMING DEVICE HAVING BELT CLEANER AND DRUM CLEANER BOTH PROVIDED IN ONE OF DRUM UNITS

CROSS REFERENCE TO RELATED APPLICATION

This application is a continuation of U.S. application Ser. No. 13/051,012 filed Mar. 18, 2011, which claims priority from Japanese Patent Application No. 2010-171999 filed Jul. 30, 2010. The entire contents of the above noted applications are incorporated herein by reference.

TECHNICAL FIELD

The present invention relates to an image forming device such as a color printer.

BACKGROUND

In well-known tandem image forming devices, photosensitive drums for colors of yellow, magenta, cyan and black are juxtaposed, and a toner image of each color is formed on the corresponding photosensitive drum substantially at the same time with one another. In case of a direct transferring system, each toner image formed on each photosensitive drum is sequentially superimposed onto a sheet passing beneath each photosensitive drum due to a circular movement of a conveyor belt. In case of an intermediate transferring system, each toner image is sequentially superimposed on an intermediate transfer belt to form a colored toner image, and the colored toner image is then transferred onto a sheet.

Some of the toner carried on each photosensitive drum may sometimes remain deposited thereon without being transferred onto the sheet or the intermediate transfer belt. To this effect, some tandem image forming devices are provided with a drum cleaner for collecting remaining toner from each photosensitive drum.

A belt cleaner has also been proposed for collecting toner remained on the conveyor belt or the intermediate transfer belt. Such belt cleaner includes a waste toner box in which the toner collected by the belt cleaner (waste toner) is stored.

When both of the drum cleaner and the belt cleaner are provided, the toner collected by the drum cleaner is ejected onto a belt, and the toner on the belt is then collected by the belt cleaner.

SUMMARY

However, conventionally, the photosensitive drums are disposed upward of the belt, while the belt cleaner is disposed below the belt. This configuration inevitably requires a large dimension in height, resulting in a large image forming device. Furthermore, when the waste toner box becomes full, the belt needs to be removed first in order to take out the waste toner box from the image forming device.

In view of the foregoing, it is an object of the present invention to provide a compact image forming device capable of facilitating disposal of waste toner.

In order to achieve the above and other objects, the present invention provides an image forming device including: a main casing; a plurality of photosensitive accommodated in the main casing; a plurality of developer cartridges each configured to be mounted in and removed from the main casing; an endless belt disposed to face each of the plurality of photosensitive drums; a plurality of first cleaning units each disposed for each of the plurality of photosensitive drums; a plurality of first conveying units each disposed for each of the first cleaning units; a second cleaning unit configured to clean waste developer deposited on the endless belt; a second conveying unit; and a third conveying unit. The plurality of photosensitive drums includes a first photosensitive drum and a plurality of second photosensitive drums. The plurality of developer cartridges includes a first developer cartridge and a plurality of second developer cartridges, the first developer cartridge corresponding to the first photosensitive drum and having a first waste developer accommodating chamber for storing waste developer, each of the plurality of second developer cartridges corresponding to each of the plurality of second photosensitive drums and having a second waste developer accommodating chamber for storing waste developer. Each first cleaning unit is configured to clean waste developer deposited on the corresponding photosensitive drum. The plurality of first conveying units is configured to convey the waste developer cleaned by the corresponding first cleaning unit. The second conveying unit is configured to convey the waste developer cleaned by the second cleaning unit. The third conveying unit is configured to convey the waste developer conveyed by the first conveying unit corresponding to the first photosensitive drum and the waste developer conveyed by the second conveying unit toward the first waste developer accommodating chamber.

DETAILED DESCRIPTION

First, a general configuration of a tandem color printer 1 according to an embodiment of the present invention will be described with reference to FIGS. 1 through 4. In the color printer 1, a drawer frame 3 according to the embodiment is mountable.

In the following description, a right side in FIG. 1 will be referred to as a front side, while a left side in FIG. 1 will be referred to as a rear side. The terms "upward", "downward", "upper", "lower", "above", "below", "beneath", "right", "left", "front", "rear" and the like will be used assuming that the color printer 1 is viewed from its front side. Also, directions with respect to the drawer frame 3 will be referenced based on an assumption that the drawer frame 3 is accommodated within the color printer 1.

Figure 1:
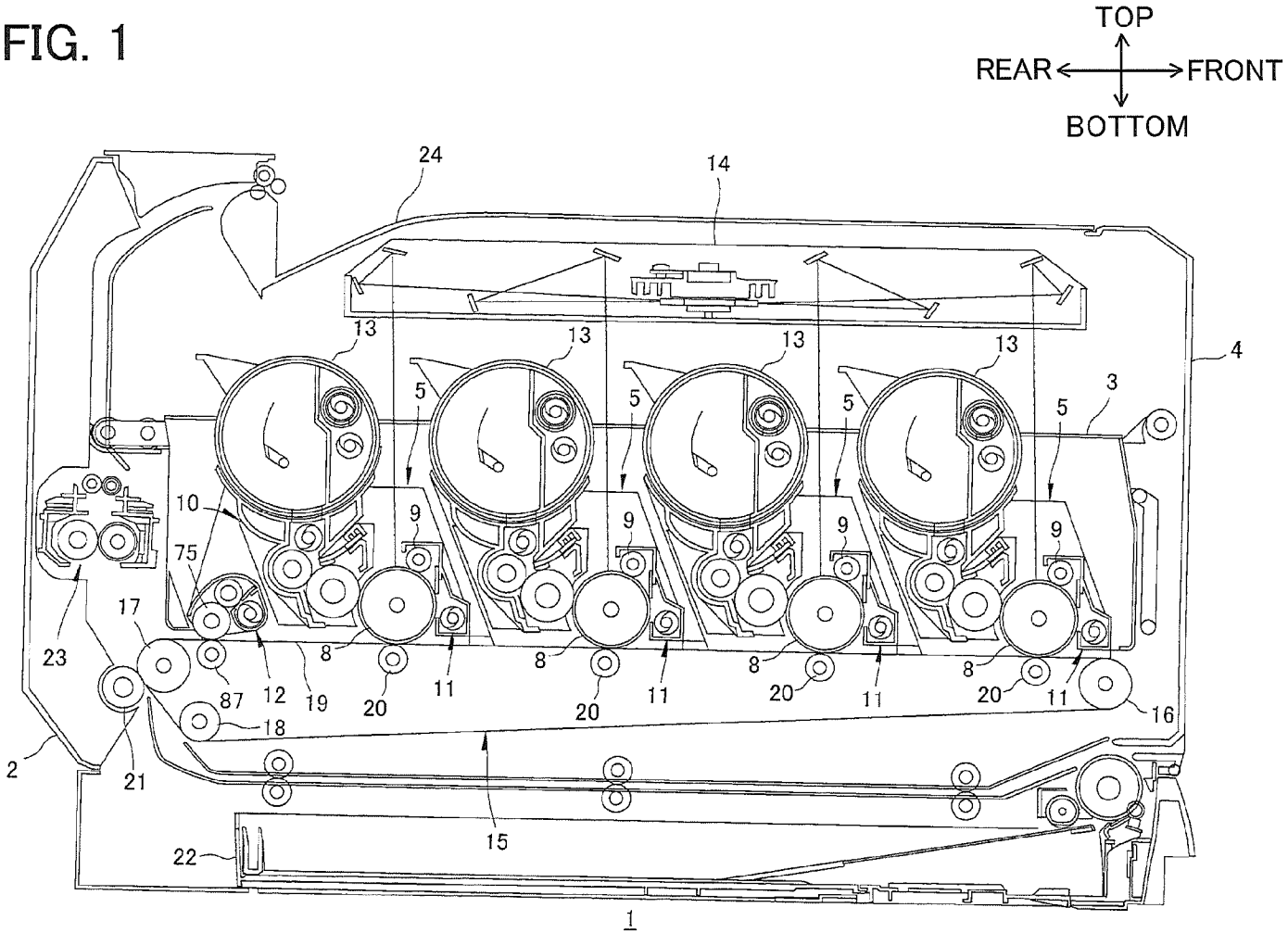
FIG. 1 is a cross-sectional view of a color printer according to an embodiment of the present invention, wherein a drawer frame is accommodated in the color printer, the drawer frame including drum units and toner cartridges.
Figure 2:
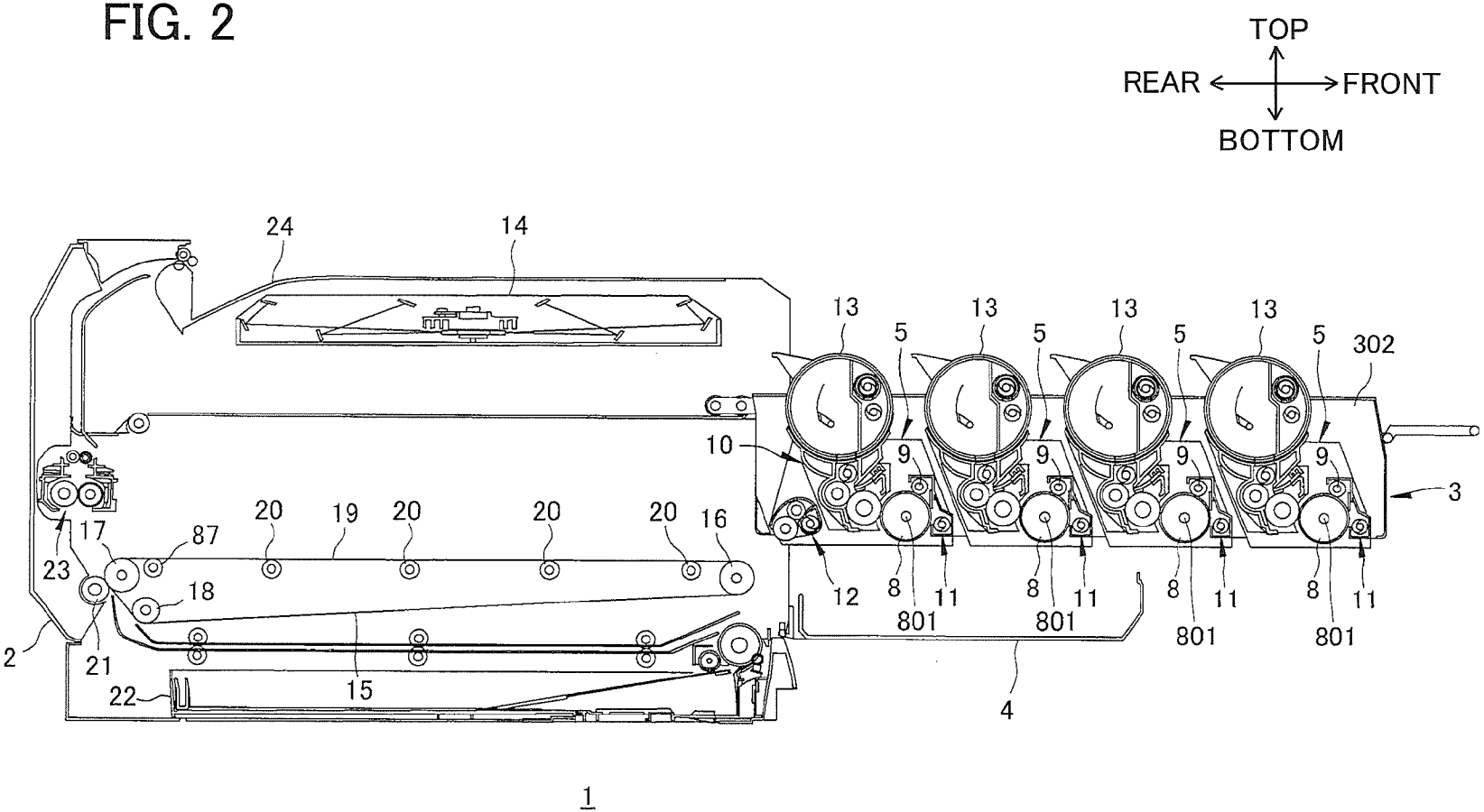
FIG. 2 is a cross-sectional view of the color printer of FIG. 1, wherein the drawer frame according to the embodiment is in a pull-out state where the drawer frame is being pulled out.

As shown in FIG. 1, the color printer 1 includes a main casing 2 within which the drawer frame 3 can be accommodated. The drawer frame 3 has a square frame shape in a plan view. A front cover 4 is pivotably movably provided at the front side of the main casing 2. When the front cover 4 is opened, the drawer frame 3 is movable relative to the main casing 2 with respect to a horizontal direction. More specifically, the drawer frame 3 is movable between an accommodated position in which the drawer frame 3 is accommodated within the main casing 2 (shown in FIG. 1), and a pull-out position in which the drawer frame 3 is pulled out from the main casing 2 (shown in FIG. 2).

In the drawer frame 3, four drum units 5 are supported. The four drum units 5 are provided respectively for four colors of black, yellow, magenta and cyan to be used in the color printer 1. The drum units 5 are juxtaposed in a front-to-rear direction according to the order of colors given above such that the drum unit 5 for black is positioned rearmost in the front-to-rear direction.

Figure 3:
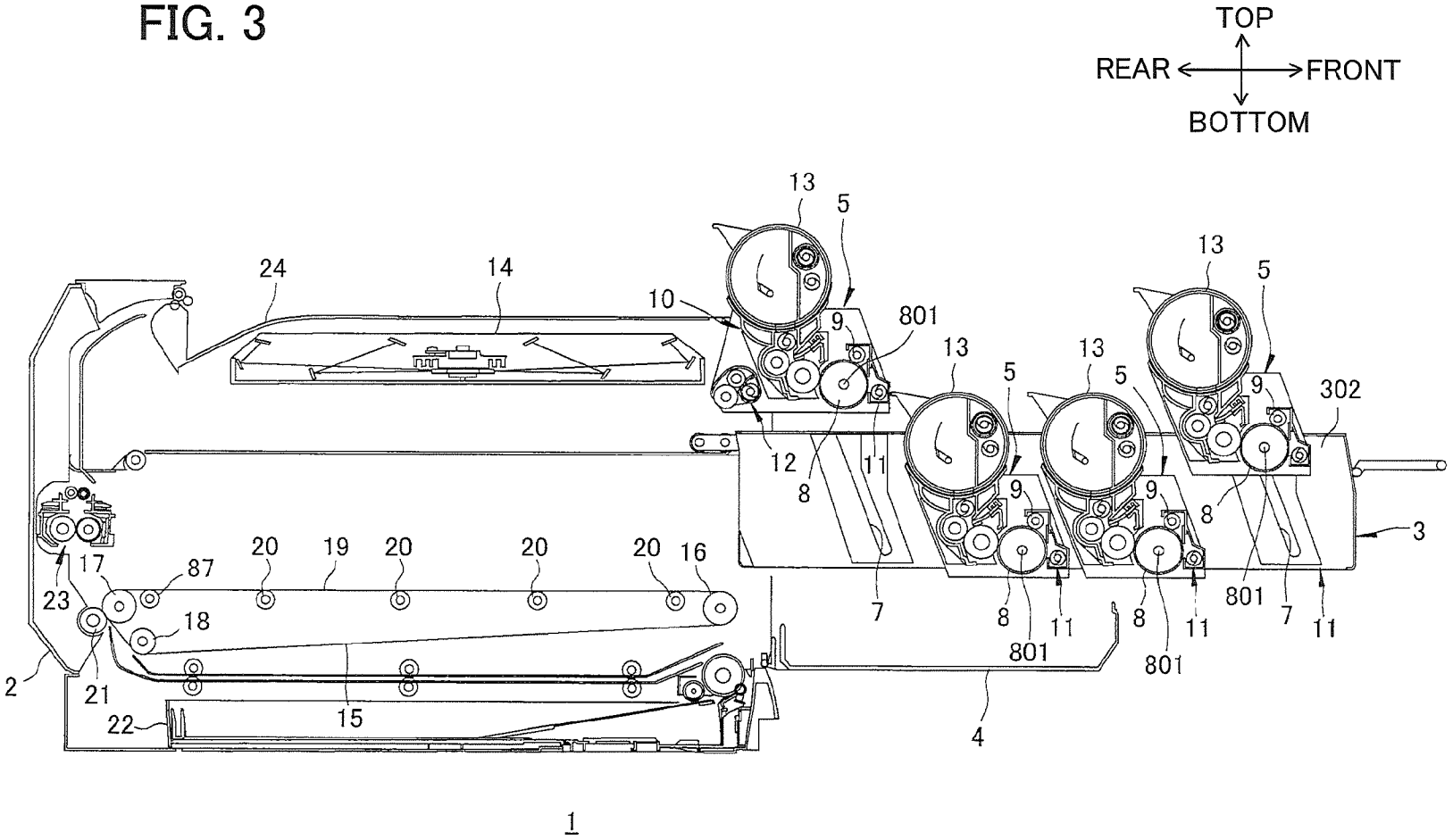
FIG. 3 is a cross-sectional view of the color printer of FIG. 1, wherein one of the drum units is removed from the drawer frame in the pull-out state.

Each drum unit 5 is detachably mountable on the drawer frame 3 from above when the drawer frame 3 is in the pull-out position, as shown in FIG. 3. More specifically, as shown in FIG. 3, the drawer frame 3 includes a left side frame (not shown) and a right side frame 302 disposed in opposition to each other in a left-to-right direction. On inner surfaces of the left side frame and the right side frame 302 (on a right side surface of the left side frame and a left side surface of the right side frame 302), four guide grooves 7 are formed respectively in correspondence with the four drum units 5. Each guide groove 7 extends diagonally downward and frontward in the front-to-rear direction. A shaft 801 of a photosensitive drum 8 (described later) is inserted into the corresponding pair of guide grooves 7 from upward thereof, such that each drum unit 5 is being mounted in the drawer frame 3 along the guide grooves 7, while the shaft 801 is slidingly moved downward within the guide grooves 7. Likewise, when the drum unit 5 is removed from the drawer frame 3, the drum unit 5 is pulled upward along the corresponding guide grooves 7.

Each drum unit 5 includes the photosensitive drum 8, a charging roller 9, a developing device 10 and a drum cleaner 11. The photosensitive drum 8 is rotatable about its axis extending in the left-to-right direction and is rotatably supported to the drum unit 5. During image formation, the photosensitive drum 8 is rotated in a counterclockwise direction when viewed from its left side (i.e., in a counterclockwise direction in FIG. 1). The charging roller 9, the developing device 10 and the drum cleaner 11 are disposed to surround the photosensitive drum 8. More specifically, as shown in FIG. 1, the charging roller 9 is disposed at a position diagonally upward and frontward of the photosensitive drum 8 and in contact with the photosensitive drum 8. The developing device 10 has a lower end portion that opposes the photosensitive drum 8 at a position rearward of the same. The drum cleaner 11 confronts the photosensitive drum 8 at a position frontward of the photosensitive drum 8. The drum unit 5 for the color of black positioned rearmost in the front-to-rear direction (hereinafter to be referred to as the drum unit 5K) is further provided with a belt cleaner 12.

Figure 4:
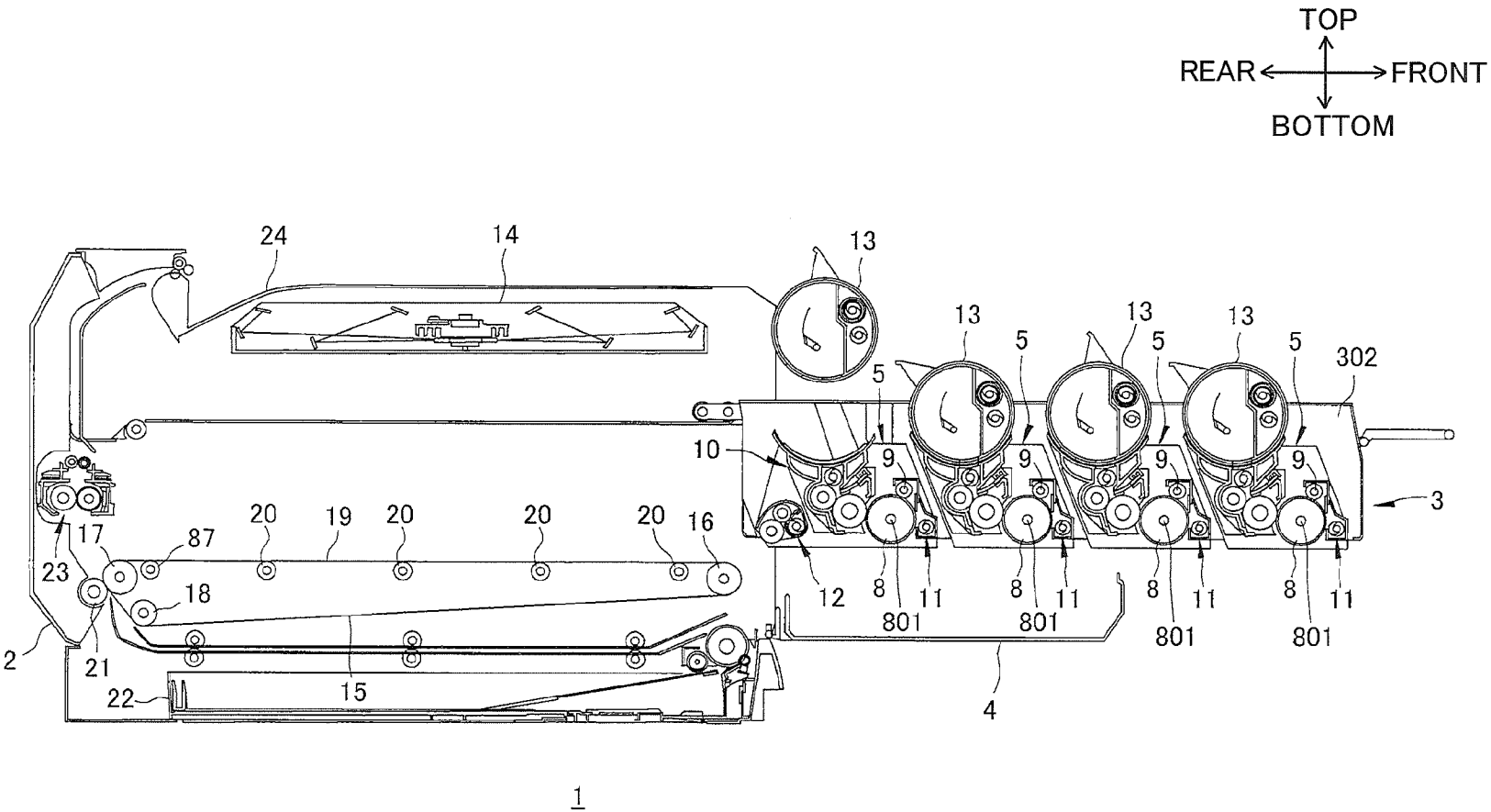
FIG. 4 is a cross-sectional view of the color printer of FIG. 1, wherein one of the toner cartridges is removed from the drawer frame in the pull-out state.

A toner cartridge 13 for storing toner therein is detachably mountable on the developing device 10 from above. As shown in FIG. 3, when the drawer frame 3 is in the pull-out position, the toner cartridge 13 is integrally detachable with the drum unit 5 relative to the drawer frame 3. Further, when the drawer frame 3 is in the pull-out position, the toner cartridge 13 alone is also removable from the drawer frame 3, while the drum unit 5 remains mounted on the drum unit 5, as shown in FIG. 4.

Within the main casing 2, an exposure device 14, an intermediate transfer belt 15, a sheet feed cassette 22 and a fixing unit 23 are also provided, as shown in FIG. 1.

The exposure device 14 is disposed at an uppermost portion of the main casing 2. The exposure device 14 is configured to irradiate four laser beams corresponding to the four colors used in the color printer 1 toward surfaces of the photosensitive drums 8. Instead of the exposure device 14, four LED arrays may be provided for the photosensitive drums 8.

As each photosensitive drum 8 rotates, the corresponding charging roller 9 applies a uniform charge to the surface of the photosensitive drum 8. Subsequently, the laser beams irradiated from the exposure device 14 selectively expose the surfaces of the photosensitive drums 8 to light. As a result of exposure to light, an electrostatic latent image is formed on the surface of each photosensitive drum 8. When toner is supplied to the electrostatic latent image from the developing device 10, the electrostatic latent image is developed into a toner image.

The intermediate transfer belt 15 is disposed below the drawer frame 3 in the accommodated position. The intermediate transfer belt 15 is an endless belt, and mounted around three rollers 16, 17 and 18 in a taut state. The two rollers 16, 17 are disposed so as to oppose each other in the front-to-rear direction and at positions identical to each other with respect to a vertical direction. The two rollers 16, 17 are separated from each other in the front-to-rear direction by a prescribed distance that is substantially identical to a length of the drawer frame 3 in the front-to-rear direction. The remaining roller 18 is disposed diagonally downward and frontward of the roller 17 that is positioned at the rear side in the main casing 2. The intermediate transfer belt 15 thus defines a planar portion 19 between the rollers 16, 17 (upper portion of the endless intermediate transfer belt 15), the planar portion 19 extending in the front-to-rear direction and the left-to-right direction. The planar portion 19 is in contact with each of the photosensitive drums 8 and a first cleaning roller 75 (to be described later).

Four primary transfer rollers 20 are disposed within a loop of the intermediate transfer belt 15 such that each primary transfer roller 20 is in confrontation with each photosensitive drum 8 via the planar portion 19.

During image formation, the intermediate transfer belt 15 circularly moves in a clockwise direction when viewed from its left side. Due to the primary transfer rollers 20, the toner images formed on the surfaces of the photosensitive drums 8 are superimposed onto the intermediate transfer belt 15, sequentially from the black toner image. A colored toner image is thus formed on the intermediate transfer belt 15.

A secondary transfer roller 21 is disposed rearward of the roller 17 so as to oppose the same via the intermediate transfer belt 15. The secondary transfer roller 21 is in contact with the intermediate transfer belt 15.

The sheet feed cassette 22 is disposed at a lower portion of the main casing 2. The sheet feed cassette 22 accommodates therein sheets of paper P. The paper P accommodated in the sheet feed cassette 22 is conveyed toward a position where the intermediate transfer belt 15 is in contact with the secondary transfer roller 21 by various rollers. Due to the secondary transfer roller 21, the colored toner image formed on the intermediate transfer belt 15 is transferred onto the paper P passing between the intermediate transfer belt 15 and the secondary transfer roller 21.

The fixing unit 23 is disposed rearward of the drawer frame 3 in the accommodated position. The paper P on which the colored toner image has been transferred is then conveyed to the fixing unit 23 whereby the toner image is fixed to the paper P by heat and pressure. After the toner image has been fixed to the paper P in the fixing unit 23, various rollers discharge the paper P onto a discharge tray 24 formed on a top surface of the main casing 2.

Next, a detailed configuration of the drum unit 5K will be described with reference to FIGS. 5 through 14 as an example for explaining a configuration of the drum unit 5. The drum unit 5K has a configuration identical to those of other three drum units 5 (for yellow, magenta and cyan) except that the belt cleaner 12 and a second conveyor unit 101 (described later) are provided only in the drum unit 5K.

Figure 5:
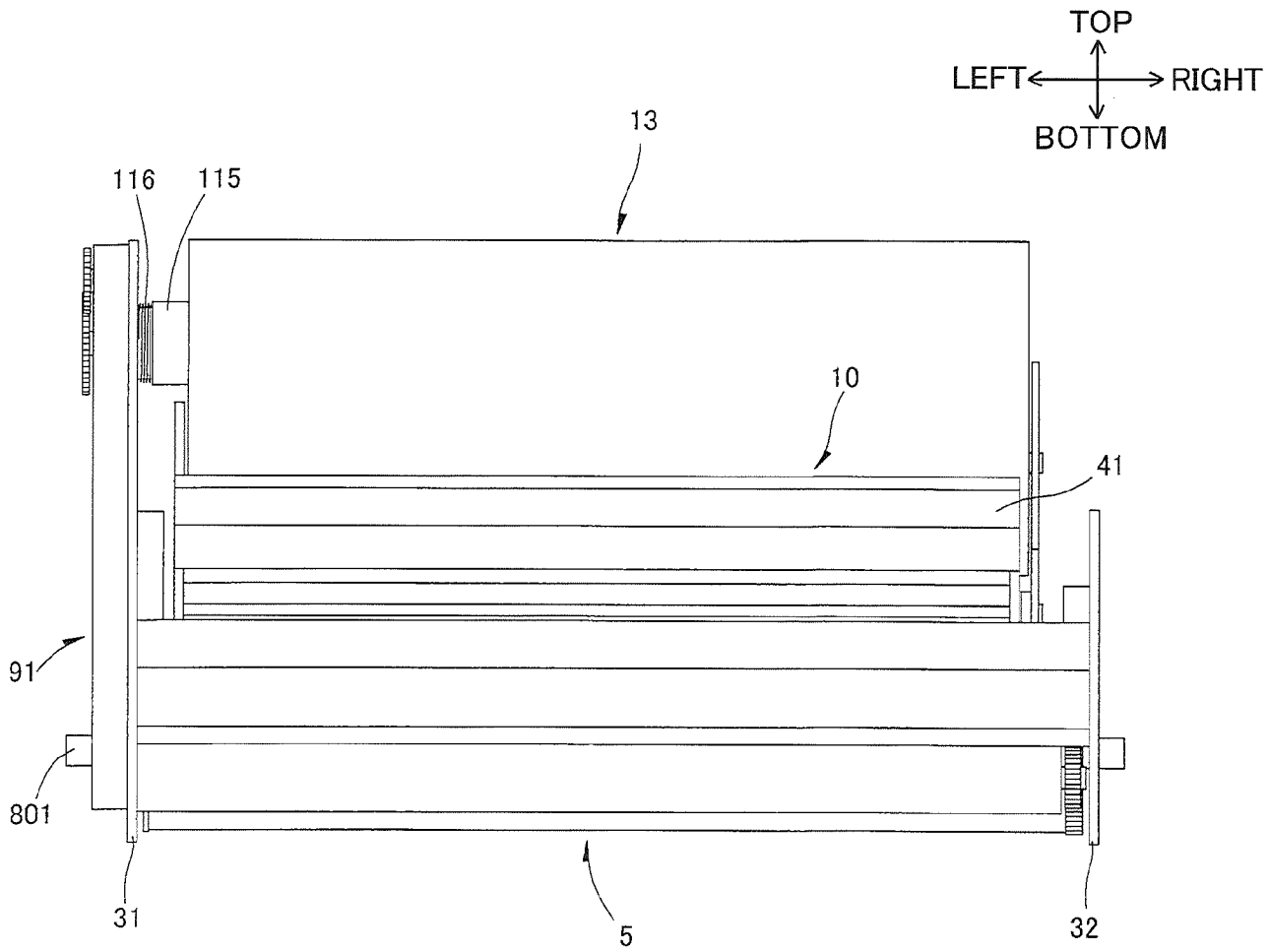
FIG. 5 is an elevation view (front side view) of the drum unit and the toner cartridge shown in FIG. 1, the drum unit including a communication unit.
Figure 6:
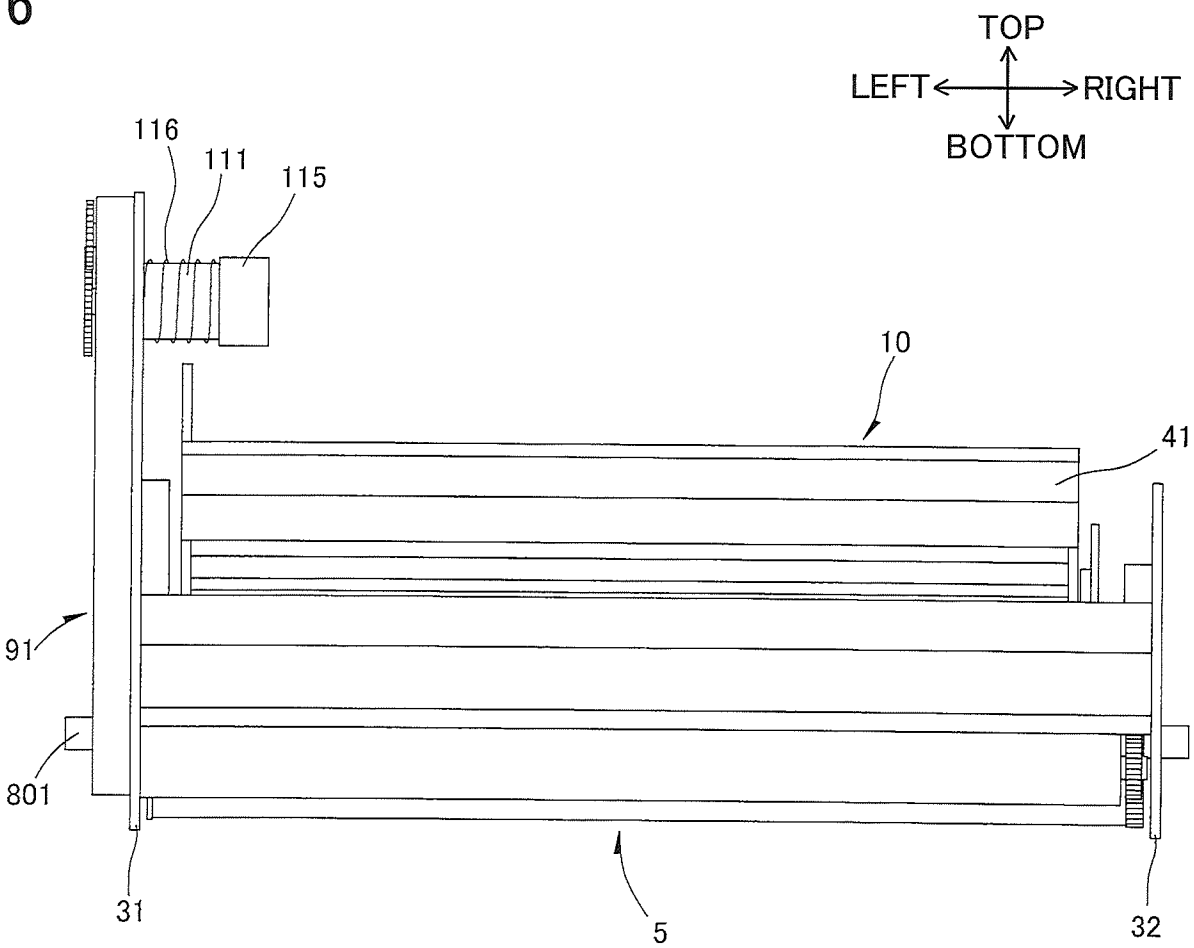
FIG. 6 is an elevation view (front side view) of the drum unit shown in FIG. 1.

As shown in FIGS. 5 and 6, the drum unit 5K includes a left side plate 31 and a right side plate 32 arranged in opposition to each other in the left-to-right direction. The charging roller 9, the developing device 10, the drum cleaner 11 and the belt cleaner 12 (shown in FIG. 1) are interposed between the left side plate 31 and the right side plate 32 and integrally held to the left side plate 31 and the right side plate 32. The left side plate 31 extends upward and has an upper end portion facing the toner cartridge 13 from leftward of the same. The right side plate 32 extends upward and has an upper end portion facing the developing device 10 from rightward of the same such that a space above the developing device 10 is exposed rearward so as to be used as a space for accommodating the toner cartridge 13 therein.

Figure 7:
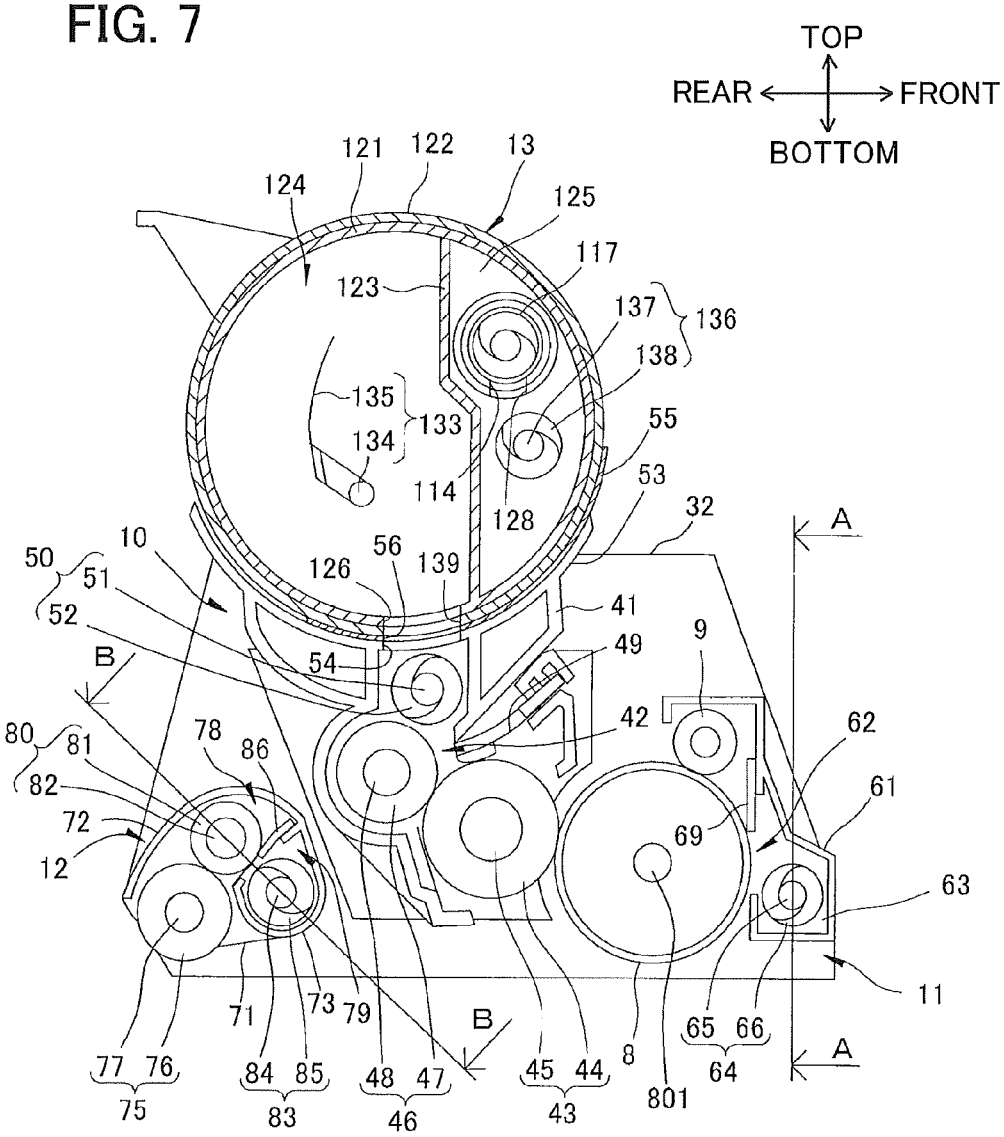
FIG. 7 is a cross-sectional view of the drum unit and the toner cartridge shown in FIG. 1, wherein a toner accommodation chamber of the toner cartridge and a developing chamber of the drum unit are in fluid communication with each other.
Figure 8:
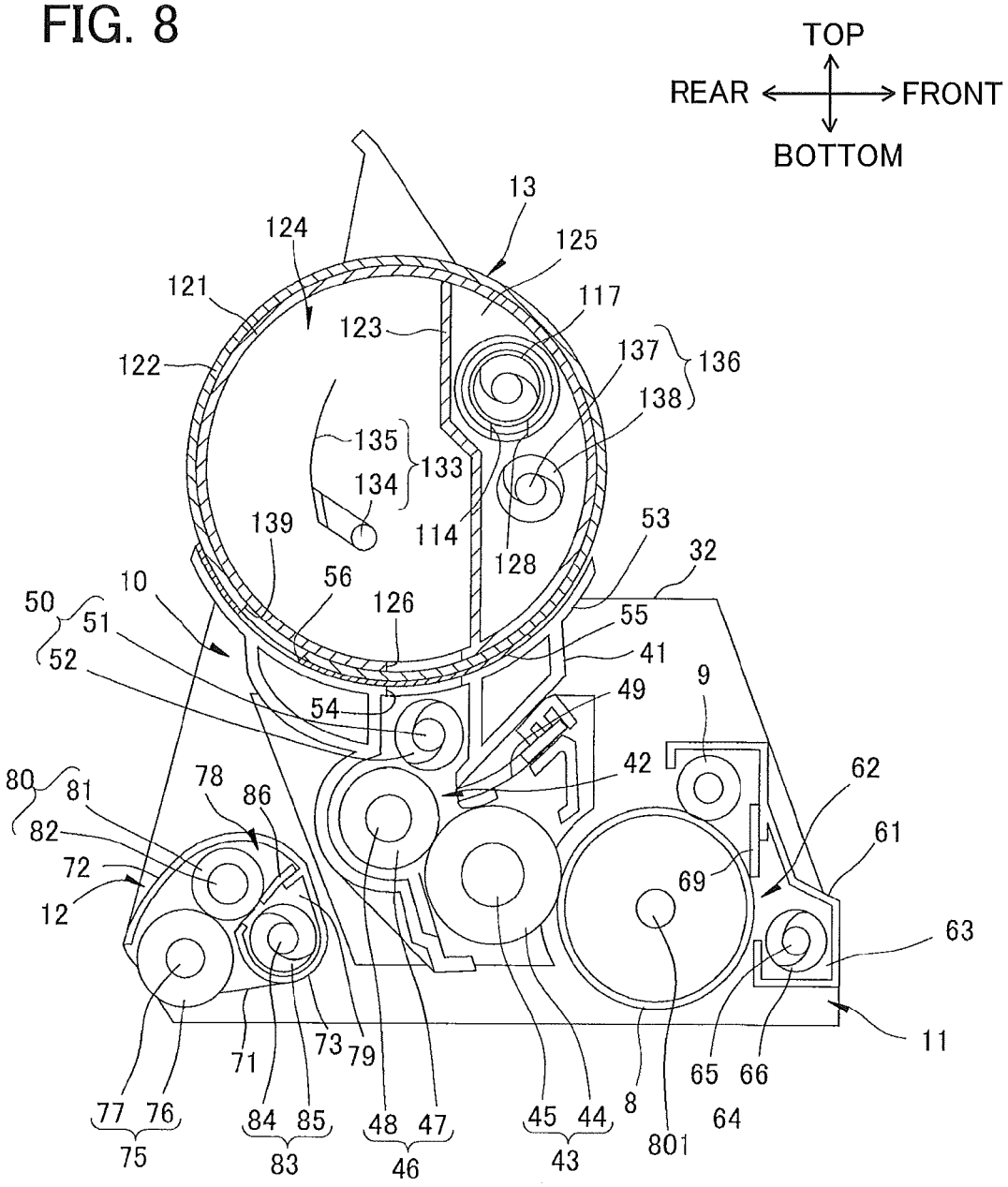
FIG. 8 is a cross-sectional view of the drum unit and the toner cartridge shown in FIG. 1, wherein the toner accommodation chamber of the toner cartridge and the developing chamber of the drum unit are prevented from communicating with each other.

The developing device 10 includes a developing device frame 41 extending between the left side plate 31 and the right side plate 32, as shown in FIGS. 5 and 6. A developing chamber 42 is formed in the developing device frame 41, as shown in FIGS. 7 and 8. The developing chamber 42 has a lower end portion that is open toward the photosensitive drum 8.

Within the developing chamber 42, a developing roller 43, a supply roller 46, a thickness-regulating blade 49 and an auger 50 are disposed.

The developing roller 43 is positioned at the lower end portion of the developing chamber 42. The developing roller 43 includes a cylindrical-shaped developing roller main body 44 and a developing roller shaft 45 extending in the left-to-right direction. The developing roller main body 44 has an axis extending in the left-to-right direction, and the developing roller shaft 45 penetrates through the developing roller main body 44 along the axis thereof. The developing roller main body 44 has an outer circumferential surface a portion of which is exposed outside of the developing chamber 42 and is in contact with the surface of the photosensitive drum 8. The developing roller shaft 45 penetrates through left and right side plates (not shown) of the developing device frame 41 and is rotatably supported to the same. The developing roller shaft 45 has widthwise ends in the left-to-right direction that are supported to the left side plate 31 and the right side plate 32 respectively.

The supply roller 46 includes a cylindrical-shaped supply roller main body 47 and a supply roller shaft 48 extending in the left-to-right direction. The supply roller main body 47 has an axis extending in the left-to-right direction, and the supply roller shaft 48 penetrates through the supply roller main body 47 along the axis of the supply roller main body 47. The supply roller 46 is disposed diagonally upward and rearward of the developing roller 43 such that the supply roller main body 47 is in contact with the developing roller main body 44. The supply roller shaft 48 is rotatably supported to the left and side plates of the developing device frame 41.

The thickness-regulating blade 49 has a thin plate-like shape. The thickness-regulating blade 49 has a base end held to the developing device frame 41 and another free end that is movable due to resilient deformation of the thickness-regulating blade 49. The free end of the thickness-regulating blade 49 is in contact with the developing roller main body 44 from upward of the same.

The auger (feeder screw) 50 is disposed at a position diagonally upward and frontward of the supply roller 46. The auger 50 includes an auger shaft 51 extending in the left-to-right direction and an auger screw 52 formed on and along the auger shaft 51 in a spiral manner. The auger shaft 51 is rotatably supported to the left side plate 31 and the right side plate 32.

As the auger 50 rotates, toner supplied within the developing chamber 42 from the toner cartridge 13 is conveyed in the left-to-right direction and dispersed along the auger 50. As the supply roller 46 rotates, the toner is supplied onto the developing roller main body 44 from the supply roller main body 47. As the developing roller 43 rotates, the toner on the developing roller main body 44 enters between the free end of the thickness-regulating blade 49 and the developing roller main body 44, and is maintained on the developing roller main body 44 as a thin layer of uniform thickness.

The developing device frame 41 is further formed with a plate-shaped partitioning wall 53 positioned between the developing chamber 42 and the space for accommodating the toner cartridge 13. The partitioning wall 53 curves in an arcuate shape, with its convex side facing the developing chamber 42.

The partitioning wall 53 is formed with a communication port 54 at a position circumferentially center of the partitioning wall 53. The communication port 54 penetrates through the partitioning wall 53 so as to allow the communication port 54 to be in fluid communication with the developing chamber 42. The auger 50 is positioned within the developing chamber 42 at a position in confrontation with the communication port 54.

A plate-shaped developing-side shutter 55 is provided on the partitioning wall 53. The developing-side shutter 55 has an accurate shape protruding toward the developing chamber 42 substantially in conformance with the arcuate-shaped outline of the partitioning wall 53. The developing-side shutter 55 is formed with a shutter opening 56 at a position corresponding to the position of the communication port 54 formed on the partitioning wall 53. The developing-side shutter 55 is movable along the partitioning wall 53 between an open position where the shutter opening 56 is in communication with the communication port 54 and a closed position where the shutter opening 56 is prevented from communicating with the communication port 54.

Figure 9:
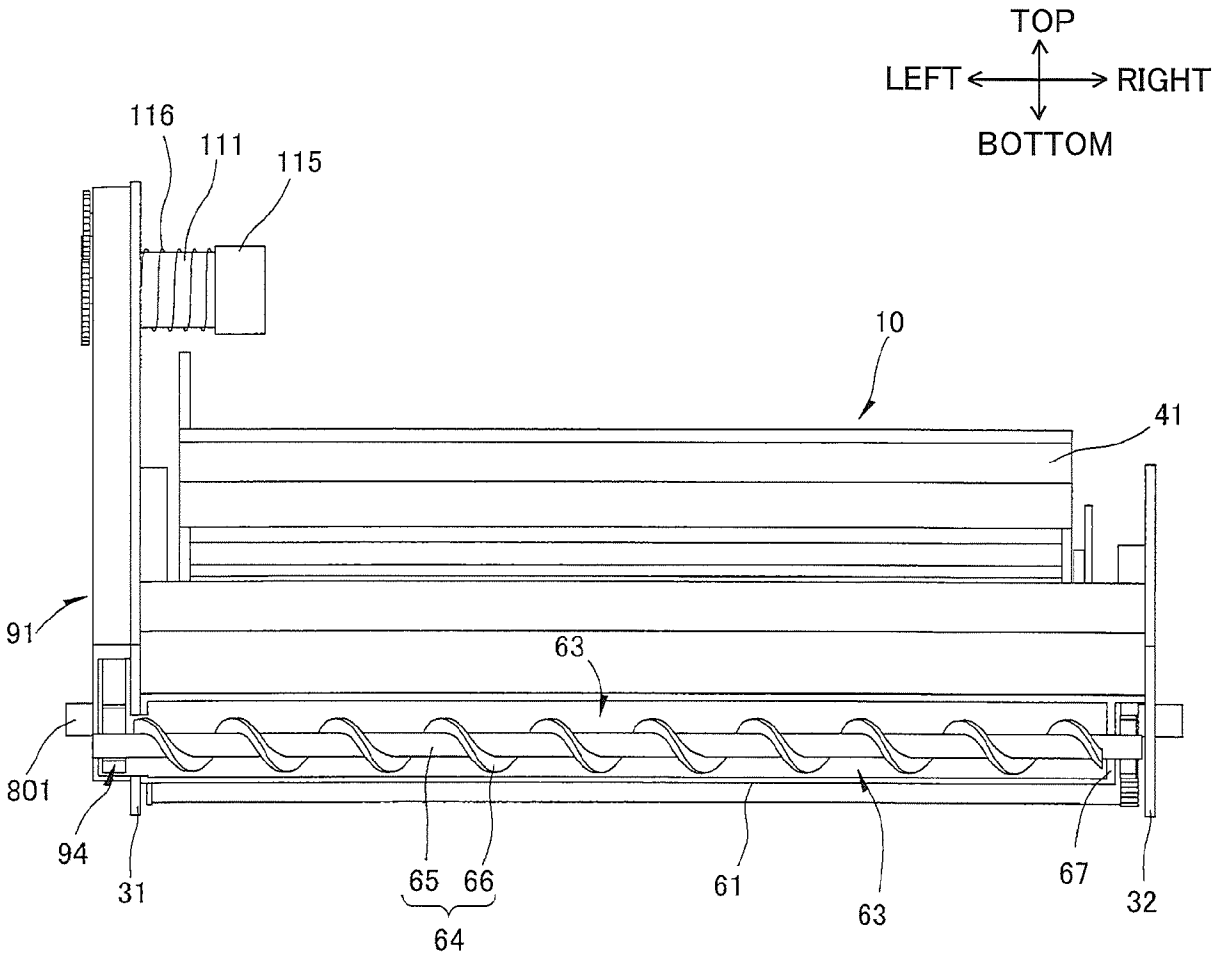
FIG. 9 is a cross-sectional view of the drum unit taken along a line A-A shown in FIG. 7.

The drum cleaner 11 includes a drum cleaner casing 61 extending in the left-to-right direction. The drum cleaner casing 61 spans across the left side plate 31 and the right side plate 32, as shown in FIG. 9. The drum cleaner casing 61 includes a cleaner opening 62 and a waste toner chamber 63. The cleaner opening 62 spans an entire width of the photosensitive drum 8 in the left-to-right direction so as to face the same. The waste toner chamber 63 is formed within the drum cleaner casing 61 and in fluid communication with the cleaner opening 62.

As shown in FIGS. 7 through 9, an auger 64 is disposed within the waste toner chamber 63. The auger 64 includes an auger shaft 65 extending in the left-to-right direction and an auger screw 66 provided on and along the auger shaft 65 in a spiral manner. The drum cleaner casing 61 has a right side wall 67 that closes (covers) the waste toner chamber 63 at a right side thereof, as shown in FIG. 9. The auger shaft 65 has a right end portion penetrating the right side wall 67 and is rotatably supported to the same. The auger shaft 65 has a left end portion that is rotatably supported to an opposing wall 92 (described later).

The drum cleaner 11 further includes a scraper 69 as shown in FIGS. 7 and 8. The scraper 69 has a plate-like shape extending in the left-to-right direction and in the vertical direction. The scraper 69 has an upper en portion that is fixed to the drum cleaner casing 61, and a lower portion that is in contact with the surface of the photosensitive drum 8 within the cleaner opening 62.

In accordance with the rotation of the photosensitive drum 8, the toner remaining deposited on the surface of the photosensitive drum 8 after the toner image is transferred onto the intermediate transfer belt 15 is scraped off from the surface of the photosensitive drum 8 by the scraper 69 as waste toner. The waste toner scraped off from the photosensitive drum 8 is received within the waste toner chamber 63 via the cleaner opening 62. Subsequently, as the auger 64 rotates, the auger 64 (the auger screw 66) conveys the waste toner leftward within the waste toner chamber 63.

Figure 10:
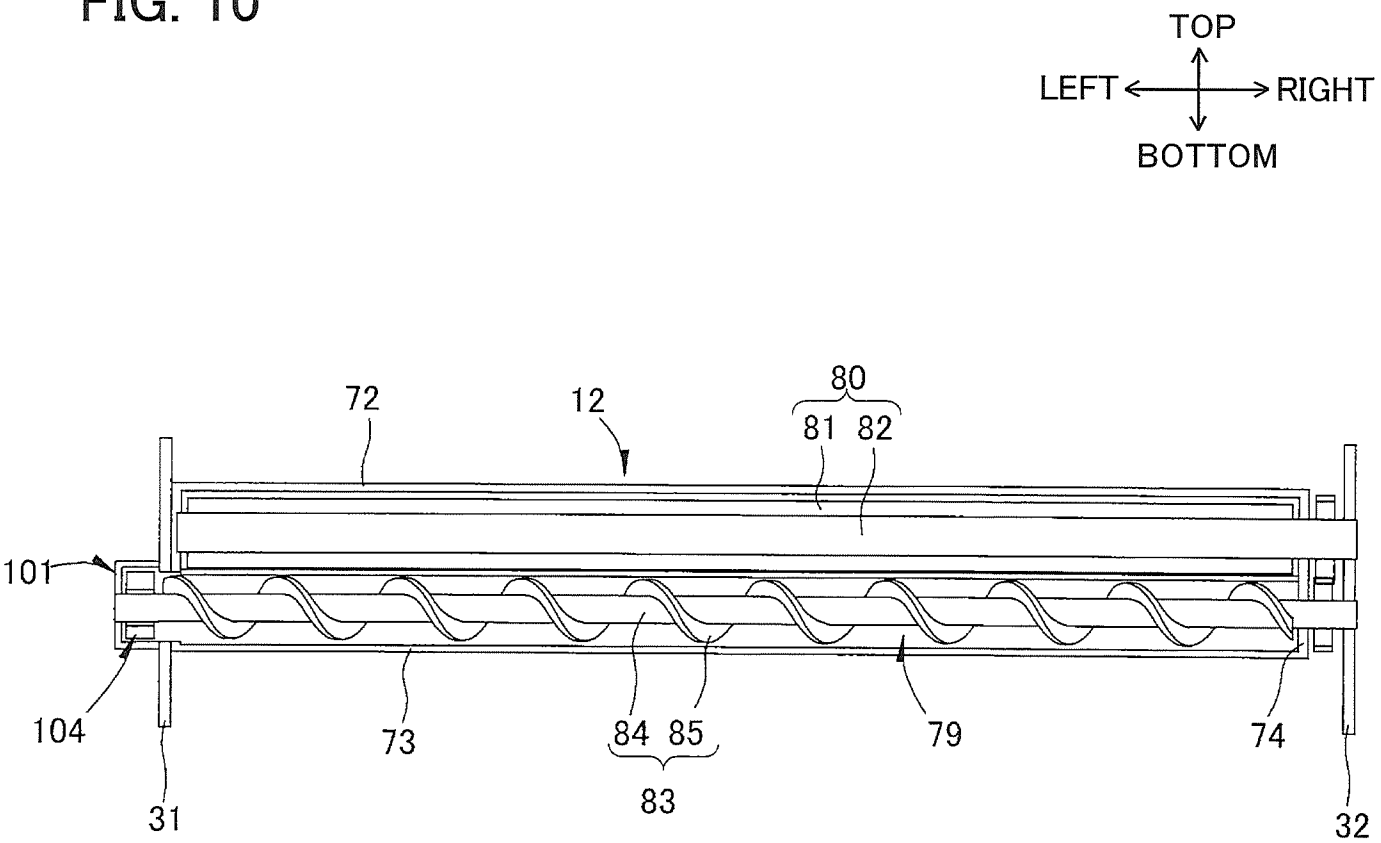
FIG. 10 is a cross-sectional view of the drum unit taken along a line B-B shown in FIG. 7.

The belt cleaner 12 includes a belt cleaner casing 71. As shown in FIGS. 7 and 8, the belt cleaner casing 71 includes a first peripheral wall 72 and a second peripheral wall 73. The first peripheral wall 72 curves in an arcuate shape in cross-section, with its convex side facing upward. The first peripheral wall 72 has a front end portion from which the second peripheral wall 73 extends downward. The second peripheral wall 73 has a substantially U-shape in cross-section, whose bottom end portion projecting downward. As shown in FIG. 10, each of the first peripheral wall 72 and the second peripheral wall 73 has a left end portion connected to the left side plate 31. The belt cleaner casing 71 also includes a right side wall 74 (see FIG. 10) defining right end portions of the first peripheral wall 72 and the second peripheral wall 73. The right side wall 74 is spaced away from the right side plate 32 of the drum unit 5K.

As shown in FIGS. 7 and 8, the first cleaning roller 75 is disposed within the drum cleaner casing belt cleaner casing 71 at a position between rear end portions of the first peripheral wall 72 and the second peripheral wall 73. The first cleaning roller 75 includes a cylindrical-shaped cleaning roller main body 76 and a cleaning roller shaft 77 extending in the left-to-right direction. The cleaning roller main body 76 has an axis extending in the left-to-right direction, and the cleaning roller shaft 77 penetrates through the cleaning roller main body 76 along the axis of thereof. The cleaning roller shaft 77 is rotatably supported to the belt cleaner casing 71.

The belt cleaner casing 71 is formed with a roller accommodation chamber 78 surrounded by the first peripheral wall 72, and a waste toner chamber 79 surrounded by the second peripheral wall 73.

A second cleaning roller 80 is further disposed within the roller accommodation chamber 78. The second cleaning roller 80 includes a cylindrical-shaped cleaning roller main body 81 and a cleaning roller shaft 82 extending in the left-to-right direction. The cleaning roller main body 81 has an axis extending in the left-to-right direction, and the cleaning roller shaft 82 penetrates through the cleaning roller main body 81 along the axis thereof. The cleaning roller main body 81 is in contact with the cleaning roller main body 76 of the first cleaning roller 75 at a position diagonally upward and frontward of the cleaning roller main body 76. As shown in FIG. 10, the cleaning roller shaft 82 has a right end portion that is rotatably supported to the right side plate 32, and a left end portion that is rotatably supported to the belt cleaner casing 71.

Within the waste toner chamber 79, an auger 83 is rotatably disposed, as shown in FIGS. 7, 8, 10. The auger 83 includes an auger shaft 84 extending in the left-to-right direction and an auger screw 85 formed on and along the auger shaft 84 in a spiral manner. As shown in FIG. 10, the auger shaft 84 has a right end portion penetrating through the right side wall 74 and rotatably supported to the right side plate 32, and a left end portion rotatably supported to an opposing wall 102 (described later).

Further, as shown in FIGS. 7 and 8, a scraper 86 is disposed at a boundary area between the roller accommodation chamber 78 and the waste toner chamber 79. The scraper 86 has a plate-like shape extending in the left-to-right direction. The scraper 86 has an upper en portion that is fixed to the belt cleaner casing 71, and a lower portion that is in contact with a surface of the cleaning roller main body 81 of the second cleaning roller 80 at a position diagonally downward and frontward of the cleaning roller main body 81.

The cleaning roller main body 76 of the first cleaning roller 75 is in contact with the intermediate transfer belt 15, as described earlier (see FIG. 1). Further, as also shown in FIG. 1, a backup roller 87 is disposed within the loop of the intermediate transfer belt 15 at a position in confrontation with the first cleaning roller 75 via the intermediate transfer belt 15.

Toner still remaining on the intermediate transfer belt 15 after the toner image has been transferred to the paper P (i.e., waste toner) is carried on a surface of the cleaning roller main body 76 of the first cleaning roller 75 when the cleaning roller main body 76 confronts the intermediate transfer belt 15 in accordance with the circular movement of the intermediate transfer belt 15. The waste toner is then transferred from the surface of the cleaning roller main body 76 of the first cleaning roller 75 to the surface of the cleaning roller main body 81 of the second cleaning roller 80. The waste toner is scraped off from the surface of the cleaning roller main body 81 by the scraper 86, and is received within the waste toner chamber 79. Subsequently, as the auger 83 rotates, the auger 83 (the auger screw 85) conveys the waste toner leftward within the waste toner chamber 79.

Incidentally, instead of the belt cleaner 12, a scraper may be provided so as to be in slidingly contact with the intermediate transfer belt 15. In this configuration, the waste toner on the intermediate transfer belt 15 can be scraped off therefrom by the scraper.

Figure 11:
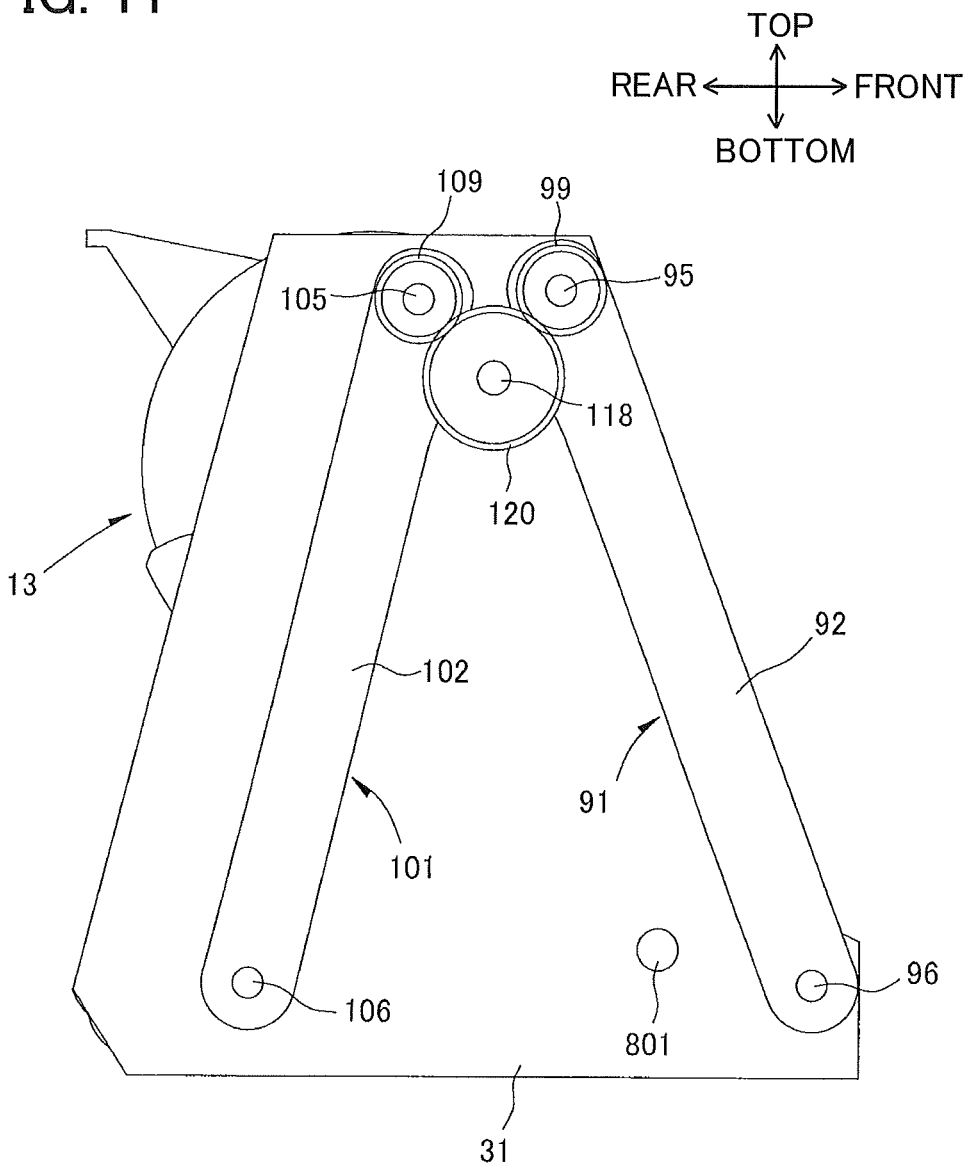
FIG. 11 is a left side view of the drum unit shown in FIG. 1.
Figure 12:
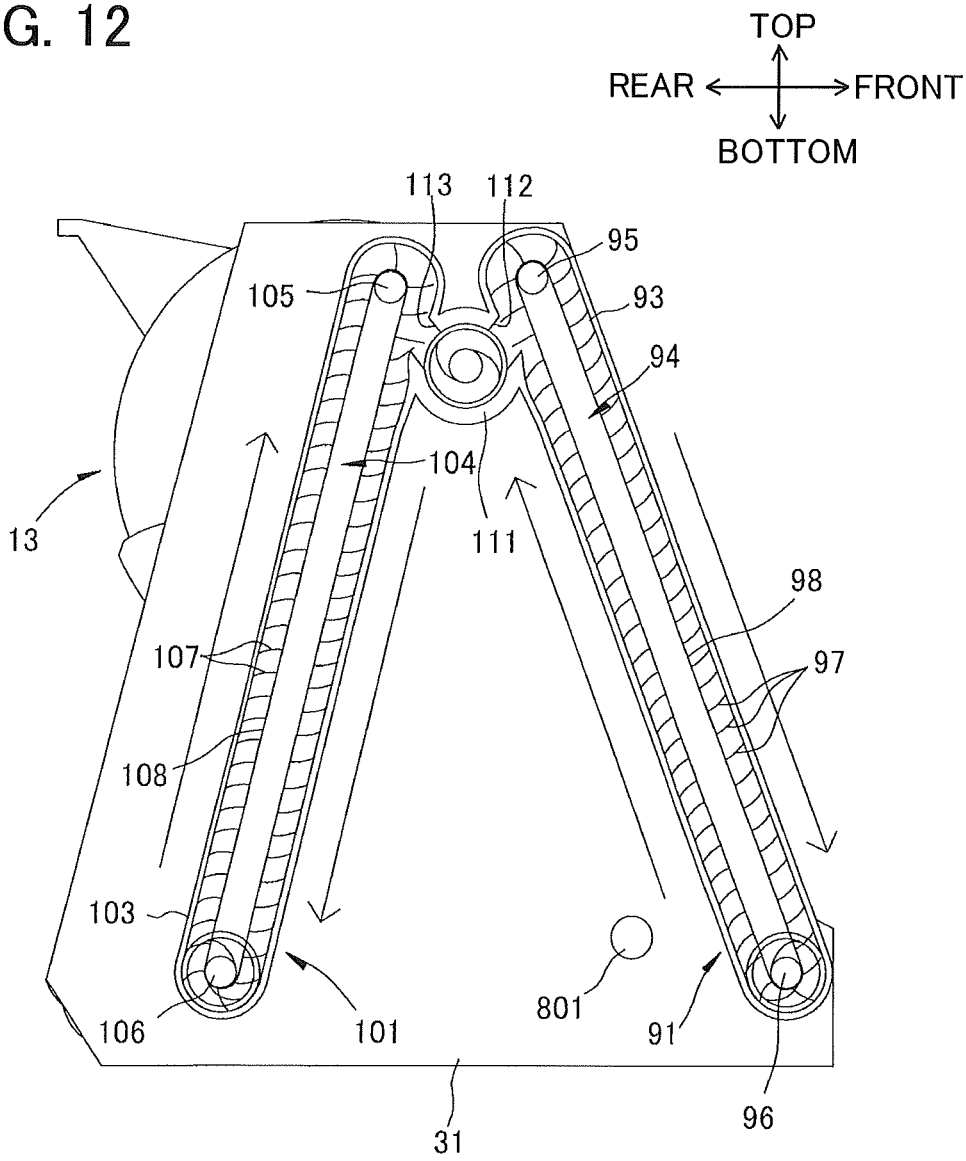
FIG. 12 is a cross-sectional view of the drum unit shown in FIG. 11.

As shown in FIG. 11, on an outer surface (left side surface) of the left side plate 31 of the drum unit 5K, a first conveying unit 91 is provided. The first conveying unit 91 has an elongated shape, extending diagonally upward and rearward from a lower front end portion to an upper end portion of the left side plate 31. The first conveying unit 91 includes the opposing wall 92 and a peripheral wall 93. The opposing wall 92 is disposed in opposition to the left side plate 31 and is spaced away therefrom. The peripheral wall 93 is formed along an entire periphery of the opposing wall 92. As shown in FIGS. 9 and 12, a space 94 is defined by the outer surface of the left side plate 31, the opposing wall 92 and the peripheral wall 93, and serves as a waste toner chamber through which waste toner is conveyed.

Belt shafts 95, 96 are respectively disposed at upper and lower end portions within the waste toner chamber 94. The belt shafts 95, 96 extend in the left-to-right direction and are rotatably supported to the opposing wall 92. An endless toner conveying belt 98 is mounted on the belt shafts 95, 96. The toner conveying belt 98 has an outer circumferential surface on which a plurality of ribs 97 is formed at regular intervals. The toner conveying belt 98 is circularly moved in a clockwise direction in a left side view, as indicated by an arrow in FIG. 12.

The belt shaft 95 has a left end protruding leftward from the opposing wall 92. The left end of the belt shaft 95 protruding from the opposing wall 92 is fitted with a gear 99, as shown in FIG. 11.

As shown in FIG. 9, the waste toner chamber 94 is in fluid communication with the waste toner chamber 63 of the drum cleaner 11. Therefore, the waste toner conveyed leftward within the waste toner chamber 63 by the auger 64 flows into the waste toner chamber 94. The waste toner flowing into the waste toner chamber 94 is then conveyed upward by the ribs 97 of the toner conveying belt 98 in accordance with the circular movement of the toner conveying belt 98.

Further, as shown in FIG. 11, on the outer surface (left side surface) of the left side plate 31 of the drum unit 5K, the second conveyor unit 101 is provided. The second conveyor unit 101 has an elongated shape, extending diagonally upward and frontward from a lower rear end portion to the upper end portion of the left side plate 31.

The second conveyor unit 101 includes an opposing wall 102 and a peripheral wall 103. The opposing wall 102 is disposed in opposition to the left side plate 31 and is spaced away therefrom. The peripheral wall 103 is formed along an entire periphery of the opposing wall 102. As shown in FIGS. 10 and 12, a space 104 is defined by the outer surface of the left side plate 31, the opposing wall 102 and the peripheral wall 103, and serves as a waste toner chamber through which waste toner is conveyed.

Belt shafts 105, 106 are respectively disposed at upper and lower end portions within the waste toner chamber 104. The belt shafts 105, 106 extend in the left-to-right direction and are rotatably supported to the opposing wall 102. An endless toner conveying belt 108 is mounted on the belt shafts 105, 106. The toner conveying belt 108 has an outer circumferential surface on which a plurality of protrusions 107 is formed at regular intervals. The toner conveying belt 108 is circularly moved in a clockwise direction in a left side view, as indicated by an arrow in FIG. 12.

The belt shaft 105 has a left end protruding leftward from the opposing wall 102. The left end of the belt shaft 105 protruding from the opposing wall 102 is fitted with a gear 109, as shown in FIG. 11.

As shown in FIG. 10, the waste toner chamber 104 is in fluid communication with the waste toner chamber 79 of the belt cleaner 12. Therefore, the waste toner conveyed leftward within the waste toner chamber 79 by the auger 83 flows into the waste toner chamber 104. The waste toner flowing into the waste toner chamber 104 is then conveyed upward by the protrusions 107 in accordance with the circular movement of the toner conveying belt 108.

Figure 13:
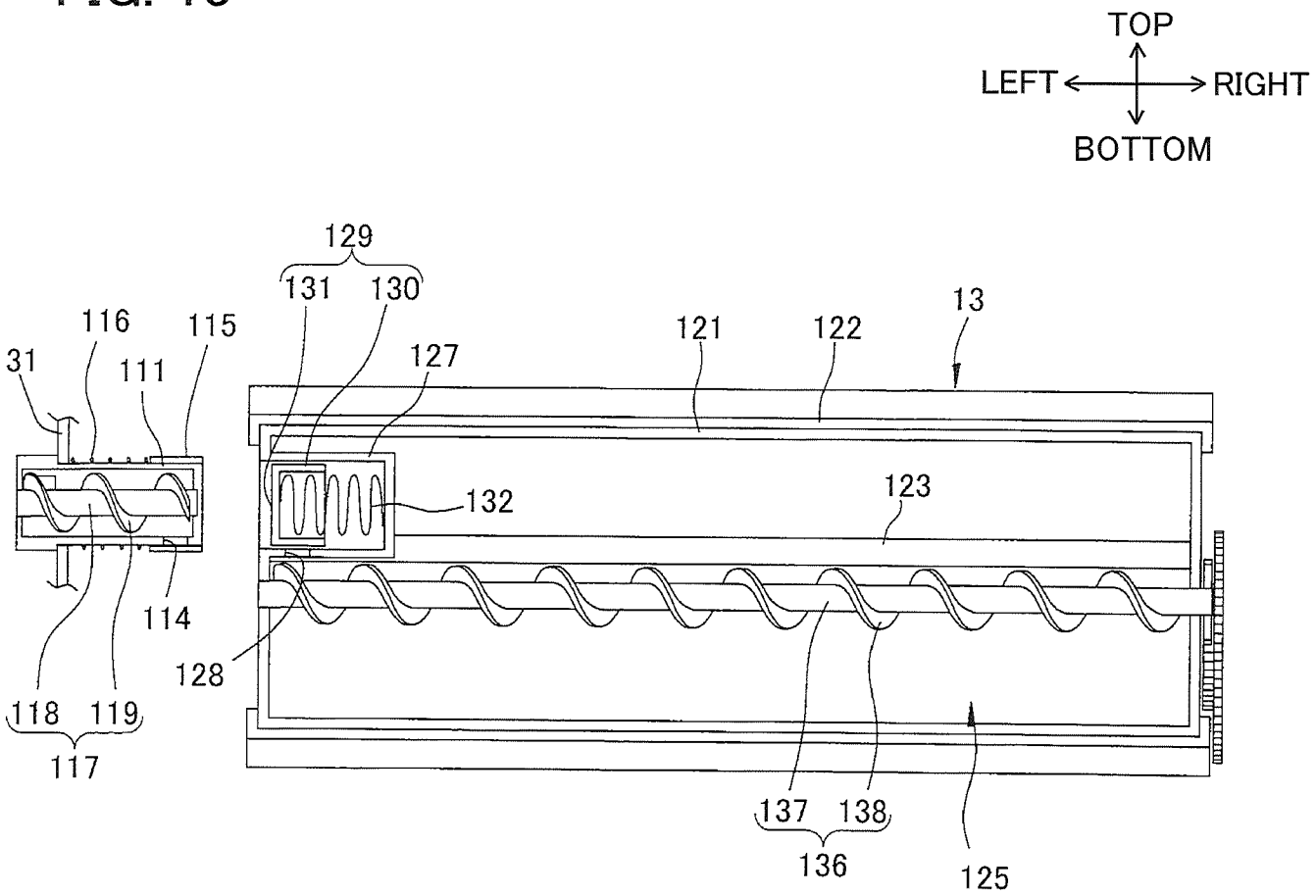
FIG. 13 is a cross-sectional view of the toner cartridge and the communication unit shown in FIG. 5, wherein the communication unit is not connected to the toner cartridge.

As shown in FIG. 12, a communication unit 111 is provided between upper end portions of the first conveying unit 91 and the second conveyor unit 101. The communication unit 111 has a hollow cylindrical shape, extending in the left-to-right direction and penetrating through the left side plate 31, as shown in FIG. 13. That is, the communication unit 111 has a left-side portion protruding leftward from the left side plate 31, and a right-side portion protruding rightward from the left side plate 31.

As shown in FIG. 12, the left-side portion of the communication unit 111 has a peripheral wall on which communication ports 112, 113 are formed, the communication ports 112, 113 penetrating through the peripheral wall. The communication port 112 is in fluid communication with the waste toner chamber 94 of the first conveying unit 91, while the communication port 113 is in fluid communication with the waste toner chamber 104 of the second conveyor unit 101.

The right-side portion of the communication unit 111 has a peripheral wall on whose bottom portion a connecting port 114 is formed, the connecting port 114 penetrating through the peripheral wall, as shown in FIG. 13.

As shown in FIGS. 9 and 13, a cylindrical-shaped shutter 115 is externally coupled to the peripheral wall of the right-side portion of the communication unit 111. The shutter 115 is movable in the left-to-right direction along the peripheral wall of the right-side portion of the communication unit 111. The shutter 115 is biased rightward by a coil spring 116 disposed between the shutter 115 and the left side plate 31.

Within the communication unit 111, an auger 117 is rotatably disposed. The auger 117 includes an auger shaft 118 extending in the left-to-right direction and an auger screw 119 formed on and along the auger shaft 118 in a spiral manner. The auger shaft 118 has a left end portion protruding leftward from the communication unit 111. The left end of the auger shaft 118 protruding from the communication unit 111 is fitted with a gear 120, as shown in FIG. 11.

The gear 120 is in meshing engagement with the gears 99, 109. Hence, when a driving fore is inputted to the gear 120, the driving force is transmitted to the respective gears 99, 109, thereby rotating the same. The rotation of the gears 99, 109 enables the toner conveying belts 98, 108 to circularly move.

The waste toner conveyed upward by the toner conveying belt 98 within the waste toner chamber 94 flows into the communication unit 111 via the communication port 112. The waste toner conveyed upward by the toner conveying belt 108 within the waste toner chamber 104 flows into the communication unit 111 via the communication port 113. As the auger 117 rotates in response to input of the driving force to the gear 120, the auger 117 (auger screw 119) conveys the waste toner rightward within the communication unit 111.

As shown in FIGS. 7 and 8, the toner cartridge 13 includes a hollow cylindrical-shaped inner casing 121 and an outer casing 122 that accommodates therein the inner casing 121. The outer casing 122 also has a hollow cylindrical shape.

A partitioning wall 123 is formed within the inner casing 121. The partitioning wall 123 partitions an internal space of the inner casing 121 into a toner accommodation chamber 124 and a waste toner accommodation chamber 125. Toner to be supplied to the developing device 10 is stored within the toner accommodation chamber 124, while collected waste toner is stored within the waste toner accommodation chamber 125.

On the inner casing 121, an inner outlet 126 is formed for allowing fluid communication between inside and outside of the toner accommodation chamber 124. The inner outlet 126 is positioned such that the inner outlet 126 is in coincidence with the communication port 54 of the partitioning wall 53 when the toner cartridge 13 is mounted on the partitioning wall 53 of the developing device frame 41.

Figure 14:
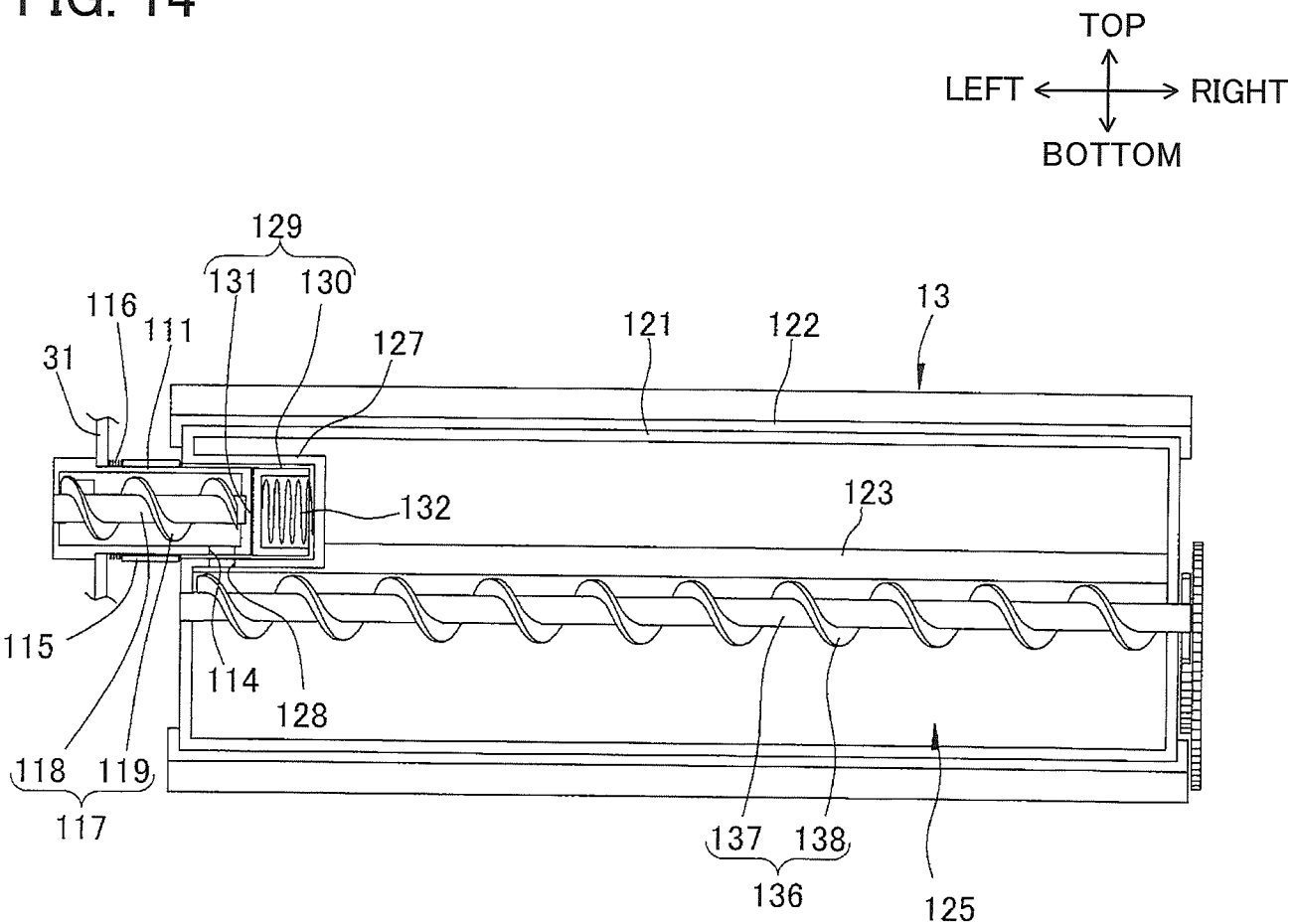
FIG. 14 is a cross-sectional view of the toner cartridge and the communication unit shown in FIG. 5, wherein the communication unit is connected to the toner cartridge.

As shown in FIGS. 13 and 14, the inner casing 121 has a left end face on which a recessed portion 127 is formed. The recessed portion 127 is protruding inward (toward the inner space of the inner casing 121) from the left end face of the inner casing 121. The recessed portion 127 has a circular-shaped side view, having an inner diameter greater than an outer diameter of the communication unit 111 but smaller than an outer diameter of the shutter 115. The recessed portion 127 has a bottom end on which a discharging port 128 is formed. The discharging port 128 opens downward and is in fluid communication with the waste toner accommodation chamber 125.

Within the recessed portion 127, a shutter 129 is movably disposed for opening and closing the discharging port 128. The shutter 129 is movable in the left-to-right direction, and integrally includes a cylindrical portion 130 and an abutment portion 131. The cylindrical portion 130 has an outer diameter substantially identical to the inner diameter of the recessed portion 127. The abutment portion 131 covers a left end of the cylindrical portion 130. A coil spring 132 is disposed between the abutment portion 131 and the recessed portion 127 such that the shutter 129 is biased leftward by the coil spring 132.

Within the toner accommodation chamber 124, an agitator 133 is disposed, as shown in FIGS. 7 and 8. The agitator 133 includes an agitator shaft 134 extending in the left-to-right direction, and an agitating film 135 held to the agitator shaft 134.

Within the waste toner accommodation chamber 125, an auger 136 is rotatably disposed. As shown in FIG. 13, the auger 136 includes an auger shaft 137 extending in the left-to-right direction and an auger screw 138 formed on and along the auger shaft 137 in a spiral manner.

As shown in FIGS. 7 and 8, on an outer circumferential surface of the outer casing 122, an outer outlet 139 is formed. The outer outlet 139 is positioned such that the outer outlet 139 is in coincidence with the inner outlet 126 with respect to the left-to-right direction. Hence, as the outer casing 122 is made to rotate (slidingly move) relative to the inner casing 121, the inner outlet 126 takes either a position where the inner outlet 126 confronts the outer outlet 139 and is in communication with the same, or another position where the inner outlet 126 is not in confrontation with the outer outlet 139. The outer outlet 139 is also positioned such that the outer outlet 139 is in confrontation with the shutter opening 56 of the developing-side shutter 55 and in communication with the same when the toner cartridge 13 is mounted on the partitioning wall 53 of the developing device frame 41.

The toner cartridge 13 is mounted within the space above the partitioning wall 53 of the developing device frame 41 (see FIG. 6) from a right side of the space. That is, at the time of installation of the toner cartridge 13, the toner cartridge 13 is moved from the right side toward a left side of the space above the partitioning wall 53. Subsequently, as shown in FIG. 13, the recessed portion 127 and the communication unit 111 are positionally-aligned with each other such that the communication unit 111 is inserted within the recessed portion 127 provided on the left end face of the inner casing 121. At this time, the shutter 115 coupled to the communication unit 111 is in confrontation with a peripheral end portion of the recessed portion 127.

As the toner cartridge 13 moves further leftward, the shutter 115 is brought into contact with the peripheral end portion of the recessed portion 127 and is prevented from being inserted within the recessed portion 127, while, in the mean time, the communication unit 111 is inserted into the recessed portion 127. As the communication unit 111 is inserted into the recessed portion 127, the communication unit 111 pushes the shutter 129 rightward. In response, the shutter 129 is moved rightward against a biasing force of the coil spring 132. When the shutter 129 moves to reach an inner right end portion of the recessed portion 127, the toner cartridge 13 is stopped from moving further, the installation of the toner cartridge 13 being completed. At this time, the connecting port 114 of the communication unit 111 is in confrontation with the discharging port 128 of the toner cartridge 13. That is, an internal space of the communication unit 111 and the waste toner accommodation chamber 125 of the toner cartridge 13 are in fluid communication with each other via the connecting port 114 and the discharging port 128.

With this configuration, the waste toner conveyed rightward by the auger 117 within the communication unit 111 flows into the waste toner accommodation chamber 125 via the connecting port 114 and the discharging port 128. In accordance with rotation of the auger 136 disposed within the waste toner accommodation chamber 125, the auger 136 conveys the incoming waste toner rightward. The waste toner is thus uniformly dispersed within the waste toner accommodation chamber 125 in the left-to-right direction.

As shown in FIG. 8, when the toner cartridge 13 has just been mounted within the space above the partitioning wall 53, the communication port 54 of the partitioning wall 53 and the shutter opening 56 of the developing-side shutter 55 do not confront each other. Further, the inner outlet 126 of the inner casing 121 and the outer outlet 139 of the outer casing 122 do not confront each other, either.

From this state, the outer casing 122 is then made to rotate in a counterclockwise direction in FIG. 8. When the toner cartridge 13 is mounted on the space above the partitioning wall 53, the outer casing 122 is connected to the developing-side shutter 55. Therefore, when the outer casing 122 is rotated, the developing-side shutter 55 is also moved in conjunction with the rotation of the outer casing 122. The outer casing 122 is rotated to a position where the outer outlet 139 opposes the inner outlet 126. As a result, as shown in FIG. 7, the outer outlet 139 is in opposition to the inner outlet 126, and the shutter opening 56 formed on the developing-side shutter 55 is in opposition to the communication port 54 formed on the partitioning wall 53. Thus, the toner accommodation chamber 124 and the developing chamber 42 are brought into fluid communication with each other, and the toner accommodated within the toner accommodation chamber 124 is supplied to the developing chamber 42.

As described above, the drum cleaner 11 is disposed for each photosensitive drum 8 for collecting waste toner deposited on the surface of the photosensitive drum 8. The belt cleaner 12 for collecting waste toner on the intermediate transfer belt 15 is provided rearward of the rearmost photosensitive drum 8 for black. The toner cartridge 13 includes the toner accommodation chamber 124 for accommodating toner to be supplied to the photosensitive drum 8, and the waste toner accommodation chamber 125 for accumulating the waste toner to be disposed.

The waste toner collected at the drum cleaner 11 is conveyed toward the waste toner accommodation chamber 125 of each toner cartridge 13 by the first conveying unit 91. The waste toner collected at the belt cleaner 12 is conveyed toward the waste toner accommodation chamber 125 of the toner cartridge 13 corresponding to the rearmost photosensitive drum 8 positioned adjacent to the belt cleaner 12. Each waste toner accommodation chamber 125 is in fluid communication with the communication unit 111 of each drum unit 5. The communication unit 111 that is in fluid communication with the waste toner accommodation chamber 125 of the toner cartridge 13 corresponding to the rearmost photosensitive drum 8 for black also serves to allow fluid communication between the first conveying unit 91 and the waste toner accommodation chamber 125, and between the second conveyor unit 101 and the waste toner accommodation chamber 125.

With this configuration, the waste toner collected from the photosensitive drum 8 for black by the drum cleaner 11 is conveyed, via the first conveying unit 91 and the communication unit 111, to the waste toner accommodation chamber 125 that is in fluid communication with the communication unit 111. To this waste toner accommodation chamber 125, the waste toner collected from the intermediate transfer belt 15 by the belt cleaner 12 is also conveyed via the second conveyor unit 101 and the communication unit 111. Therefore, a separate waste toner box for storing the waste toner collected from the intermediate transfer belt 15 is not necessary. The color printer 1 can be thus made compact.

Further, the waste toner collected from both of the photosensitive drum 8 and the intermediate transfer belt 15 can be disposed at a time just by replacing the toner cartridge 13 corresponding to the black photosensitive drum 8. Furthermore, since the intermediate transfer belt 15 is not required to be removed for replacing each toner cartridge 13, efforts required to dispose the waste toner can be greatly reduced.

Further, the communication unit 111 is connected to the left end face of the toner cartridge 13. The waste toner collected by the drum cleaner 11 and the belt cleaner 12 is conveyed first leftward by the augers 64, 83, then upward by the first conveying unit 91 and the second conveyor unit 101, and finally to the waste toner accommodation chamber 125 from its left side via the communication unit 111.

The auger 136 provided within the waste toner accommodation chamber 125 conveys the waste toner flowing from the communication unit 111 into the waste toner accommodation chamber 125 rightward. Therefore, the waste toner can be dispersed in the left-to-right direction within the waste toner accommodation chamber 125. As a result, the waste toner is prevented from accumulating at an area in the vicinity of the communication unit 111 within the waste toner accommodation chamber 125. The flow of the waste toner from the communication unit 111 into the waste toner accommodation chamber 125 can be made smooth and secured.

Further, each photosensitive drum 8, the drum cleaner 11, the communication unit 111, the first conveying unit 91 and the second conveyor unit 101 are integrally supported to the left side plate 31 and the right side plate 32. More specifically, the side plates 31, 32 retaining the rearmost photosensitive drum 8 for black integrally support the drum cleaner 11, the belt cleaner 12, the first conveying unit 91 and the second conveyor unit 101. The pair of side plates 31, 32 retaining each of the remaining three photosensitive drums 8 supports the drum cleaner 11 corresponding to the photosensitive drum 8, and the first conveying unit 91. Therefore, the black photosensitive drum 8, the drum cleaner 11, the belt cleaner 12, the first conveying unit 91 and the second conveyor unit 101 can be treated as an integral unit, while each of the other three photosensitive drums 8, its drum cleaner 11 and first conveying unit 91 can be treated as an integral unit.

Further, the four toner cartridges 13 can be integrally pulled out from the main casing 2 via the drawer frame 3. Therefore, replacement of the toner cartridge 13 for black that is positioned rearmost in the front-to-rear direction can be facilitated.

Although the present invention has been described with respect to the specific embodiment thereof, it will be appreciated by one skilled in the art that a variety of changes may be made without departing from the scope of the invention.

What is claimed is:

1. An image forming device comprising:

a photosensitive drum rotatable about a first axis extending in a first direction;

a drum cleaner configured to remove waste developer on the photosensitive drum;

a developer cartridge having a waste developer chamber;

a belt configured to contact the photosensitive drum;

a belt cleaner configured to remove waste developer from the belt;

a first conveyer extending in the first direction and configured to convey the waste developer removed by the belt cleaner in the first direction;

a second conveyer extending in a second direction intersecting with the first direction and configured to convey the waste developer conveyed by the first conveyer in the second direction;

a third conveyer extending in the first direction and configured to convey the waste developer removed by the drum cleaner in the first direction;

a fourth conveyer extending in a third direction intersecting with the first direction, the third direction being different from the second direction, the fourth conveyer being configured to convey the waste developer conveyed by the third conveyer in the third direction; and a fifth conveyer connected to the second conveyer and the fourth conveyer and extending in a fourth direction opposite to the first direction, the fifth conveyer being configured to convey the waste developer conveyed by the second conveyer and the waste developer conveyed by the fourth conveyer in the fourth direction toward the waste developer chamber.

2. The image forming device according to claim 1, wherein the developer cartridge is configured to store toner of a black color as developer.

3. The image forming device according to claim 1, further comprising a drum frame supporting the photosensitive drum, the drum cleaner, the third conveyer and the fourth conveyer.

4. The image forming device according to claim 3, wherein the drum frame further supports the belt cleaner, the first conveyer, the second conveyer and the fifth conveyer.

5. The image forming device according to claim 4, wherein the fifth conveyer comprises a communication port and a shutter configured to open and close the communication port, and wherein the waste developer chamber comprises a discharging port and a cartridge shutter configured to open and close the discharging port, the shutter of the fifth conveyer and the cartridge shutter of the waste developer chamber opening the communication port and the discharging port, respectively, when the developer cartridge is placed on the drum frame to establish fluid communication between the fifth conveyer and the waste developer chamber via the communication port and the discharging port.

6. The image forming device according to claim 1, wherein the drum cleaner comprises a scraper.

7. The image forming device according to claim 6, wherein the scraper has a plate-like shape extending in the first direction.

8. The image forming device according to claim 1, wherein the belt cleaner comprises a roller.

9. The image forming device according to claim 1, wherein the first conveyer is an auger.

10. The image forming device according to claim 9, wherein the auger has an auger shaft extending in the first direction and an auger screw formed on the auger shaft.

11. The image forming device according to claim 1, wherein the second conveyer comprises an endless belt.

12. The image forming device according to claim 11, wherein the endless belt is mounted on a first belt shaft and a second belt shaft.

13. The image forming device according to claim 1, wherein the third conveyer is an auger.

14. The image forming device according to claim 13, wherein the auger has an auger shaft extending in the first direction and an auger screw formed on the auger shaft.

15. The image forming device according to claim 1, wherein the fourth conveyer comprises an endless belt.

16. The image forming device according to claim 15, wherein the endless belt is mounted on a third belt shaft and a fourth belt shaft.

17. The image forming device according to claim 1, wherein the fifth conveyer comprises an auger.

18. The image forming device according to claim 17, wherein the auger has an auger shaft extending in the fourth direction and an auger screw formed on the auger shaft.

* * * * *